United States Patent [19]

Heerema et al.

[11] 4,231,313

[45] Nov. 4, 1980

[54] STABILIZING SYSTEM ON A SEMI-SUBMERSIBLE CRANE VESSEL

[75] Inventors: Pieter S. Heerema, Kapellen, Belgium; Alexandre Horowitz, Eindhoven; Henricus P. Willemsen, Aarle-Rixtel, both of Netherlands

[73] Assignee: Varitrac AG, Zug, Switzerland

[21] Appl. No.: 913,608

[22] Filed: Jun. 7, 1978

Related U.S. Application Data

[63] Continuation of Ser. No. 769,002, Feb. 16, 1977, abandoned.

[30] Foreign Application Priority Data

Feb. 19, 1976 [NL] Netherlands ..... 7601712
Nov. 11, 1976 [NL] Netherlands ..... 7613007

[51] Int. Cl.[3] ..... B63B 35/02

[52] U.S. Cl. ..... 114/265; 114/125; 212/146

[58] Field of Search ..... 114/264, 265, 330, 331, 114/333, 121–125; 9/8 R, 8 P, ; 212/3; 405/205–208

[56] References Cited

U.S. PATENT DOCUMENTS

| | | | |
|---|---|---|---|
| 2,887,976 | 5/1959 | Hanna | 114/16 E |
| 2,889,795 | 6/1959 | Parks | 114/125 |
| 3,349,740 | 10/1967 | Field | 114/125 |
| 3,537,412 | 11/1970 | Henderson | 114/125 |
| 3,716,154 | 2/1973 | Berg | 114/125 |
| 3,785,313 | 1/1974 | Rosenberg | 9/8 P |
| 3,835,800 | 9/1974 | Lloyd | 212/3 |
| 3,894,503 | 7/1975 | McClure | 114/265 |
| 3,928,754 | 12/1975 | Edlund | 114/125 |
| 4,010,704 | 3/1977 | Mayo | 114/125 |

*Primary Examiner*—Trygve M. Blix
*Assistant Examiner*—D. W. Keen
*Attorney, Agent, or Firm*—Haseltine, Lake & Waters

[57] ABSTRACT

A vessel comprising a pair of laterally spaced elongated buoyancy hulls and vertically mounted thereon a plurality of hollow columns, distributed around the outer circumferential area of the vessel and supporting a work platform above the water level when the hulls are submerged, the hulls containing water ballast compartments. The platform supports one or more heavy duty cranes, adapted for outboard handling of loads. At the lower end of the columns, air chambers are provided in open connection with the surrounding water at their bottom ends. At their upper ends these chambers have air valves for discharging air from and supplying air to the chambers selectively controlled by directions from a computer which is added to the crane operating device. Sensors and other measuring instruments are provided, such as, for continuously gauging the water levels in the different air compartments, the air pressure therein and the water pressure at the exit of these compartments to the open water, the top and swivel angles of the cranes, the hilt of the vessel and the weight of the crane loads. The data measured by these instruments are introduced into the computer which controls the regulator air valves and thereby the water levels in the different air chambers whereby the vessel is maintained substantially on an even keel during load handling by the cranes.

7 Claims, 4 Drawing Figures

STABILIZING SYSTEM ON A SEMI-SUBMERSIBLE CRANE VESSEL

CROSS-RELATED APPLICATION

This Application is a continuation of Ser. No. 769,002 filed Feb. 16, 1977 and now abandoned.

BACKGROUND OF THE INVENTION (a) Field of the Invention

The present invention is directed to stabilization of a semi-submersible vessel during outboard handling of loads by cranes on the vessel, the vessel comprising a platform above the water level supported by hollow columns from submersed buoyancy hulls.

(b) Prior Art

Marine structures of this type are less affected by the movement of the sea surface in rough water than vessels floating on the surface and the former have therefore been developed for drilling operation in open sea. However, they present the disadvantage of relatively small stability. Apart from the drilling derrick which is a centrally positioned fixed structure only small cranes for handling light loads can be used on a vessel of this type.

Still it has been proposed in the known art to adapt a vessel of this kind for outboard handling of loads, for instance, by means of a gantry crane mounted near the front of the vessel and to stabilize it by means of water transport to and from ballast tanks in the submersed hulls.

According to this known system a list is imparted to the vessel before hoisting an outboard load opposite the list which is expected to be imparted by hoisting the load.

However, the varying tilts imparted to the vessel during load operation are troublesome for the work and for living on the platform.

Also the maximum admissible preliminary list is limited and therefore only loads up to about 250 tons can be handled and that at a limited distance from the centerline of the vessel. For handling heavier loads the vessel has to be brought in a floating position with the buoyancy hulls at sea level, but there they are exposed to the water movement at the surface and therefore no loads can be handled when the sea is rough.

SUMMARY OF THE INVENTION

The present invention is directed to load handling stabilization to such an extent, that the semi-submersed marine structure can continuously be maintained on substantially an even keel during outboard handling of heavy loads up to e.g. 3000 tons on a rough sea with wave heights far above 1.50 m.

It is of great importance for the rentability of the large capital invested in the vessel and salaries paid to the staff of the vessel that the work goes on during periods of less favorable weather circumstances, during which until now the work had to be stopped.

The present invention is particularly directed to the use, for this purpose, of air chambers in the vessel below the sea level which are distributed along the circumferential outer zone of the vessel along the buoyancy hulls, these chambers being open to the surrounding water at their lower side and connected at their upper part to controlled air inlet and outlet conducts. An air compressor provides for compressed air to be forced into the chambers.

The application of such controlled air chambers is known per se from U.S. Pat. No. 2,889,795 describing a marine structure for drilling operations wherein said air chambers are enclosed in vertical columns which serve as buoyancy tanks for a derrick platform above sea level. An air distribution system connected to said chambers which keep the structure afloat, is applied in this known art at the same time for compensating unequal loading of the platform as well as for compensating the influence of a disturbed water surface by waves, which cause differences in water levels in the different floats.

In the system of the present invention, however, the buyoancy of the marine structure as a whole is supplied by the submerged hulls on which the columns are mounted and therefore the stability is substantially unaffected by a rough sea as the columns bearing the platform can have relatively small cross sectional dimensions.

In further distinction to the prior art the present invention is mainly directed to the application of air chambers having a volume in relation to the compensation of tilting moments on the vessel caused by hoisting, slewing and traversing outboard loads by the cranes on a work vessel, the arrangements for selective control of the air chamber valves being added to those for serving the crane movements.

It is a further object of the present invention to feed into a computer indications about air pressure and/or water level in the air chambers, hilt of the vessel, apex and angle of rotation of the crane jib and load weight recorded by sensors and measuring devices positioned at proper control spots as well as commands from the crane operation device, said computer selectively controlling, according to predetermined computer programs, the regulator air valves of the air chambers in dependence of the position of the crane load with respect to the vessel.

SURVEY OF THE DRAWINGS

In the drawings identical references have been employed to designate functionally corresponding parts though they may not have the same shape in different Figures.

DESCRIPTION OF PREFERRED EMBODIMENTS

The vessel as a whole is designated by 1. A work platform 2 is supported by hollow columns as indicated by 3-6 and these are vertically mounted on two submerged buoyancy hulls 7*a* and 7*b* which run parallel to the longitudinal axis of the vessel 1.

Figure 1:
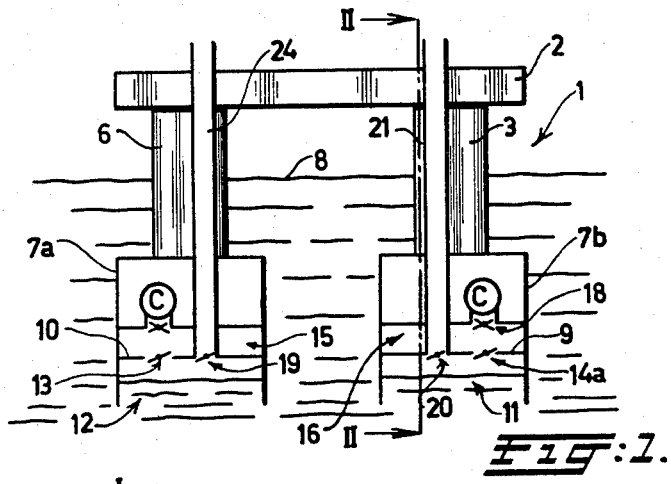
FIG. 1 is a schematic view of a cross section along the line I—I of FIG. 2 through a vessel showing the principle of the present invention.
Figure 2:
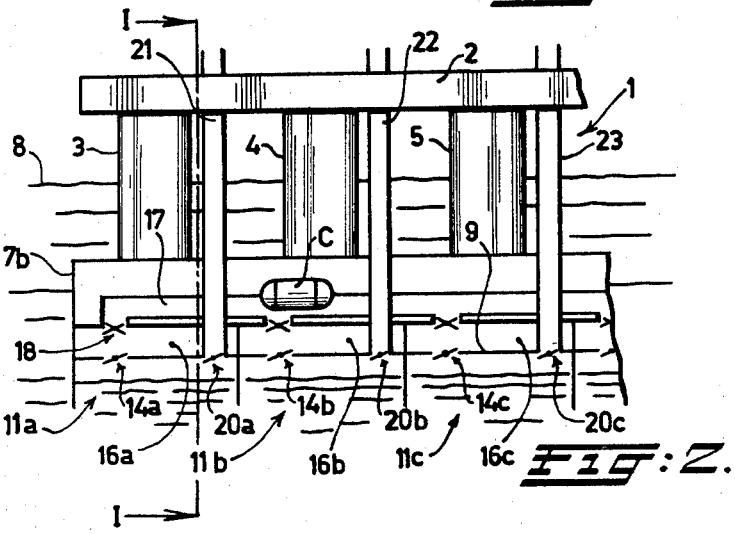
FIG. 2 is a longitudinal section taken along line II—II of FIG. 1.

The columns are distributed along the circumferential zone of the vessel and at the lower end of each of them is an air compartment as indicated in FIG. 1 for columns 2 and 3 by 11 and 12 and by 11*a*-11*c* for columns 3-5 in FIG. 2. The ceilings 9 and 10 of these air chambers are below the sea level 8 and their lower ends are in open connection with the surrounding water. Air can be forced into each chamber through a controlled air regulator valve 13-14*a-c* respectively, connecting the chamber with a compressed air volume in chambers 15, 16*a-c*, respectively, at a pressure above that in chambers 11*a-c*, 12. The compressed air is provided by air compressors C feeding air into a conduit as indicated by 17 in FIG. 2 which is common for the reserve compressed air chambers 15, 16*a-c* and connectible with each of them by valves as designated by 18.

Each air chamber 15, 16*a-c* further has an air outlet conduit to the open air as indicated by 21-24, each under control of a valve 19, 20*a-c*. Each air outlet conduit may have a branch conduit (not shown) leading to the suction side of a compressor. By the provision of additional valves in said branch and in the main conduit beyond the branch, it can be made possible to guide the air from the corresponding air chamber at choice to the suction side of the compressor or into the open air.

Figure 3:
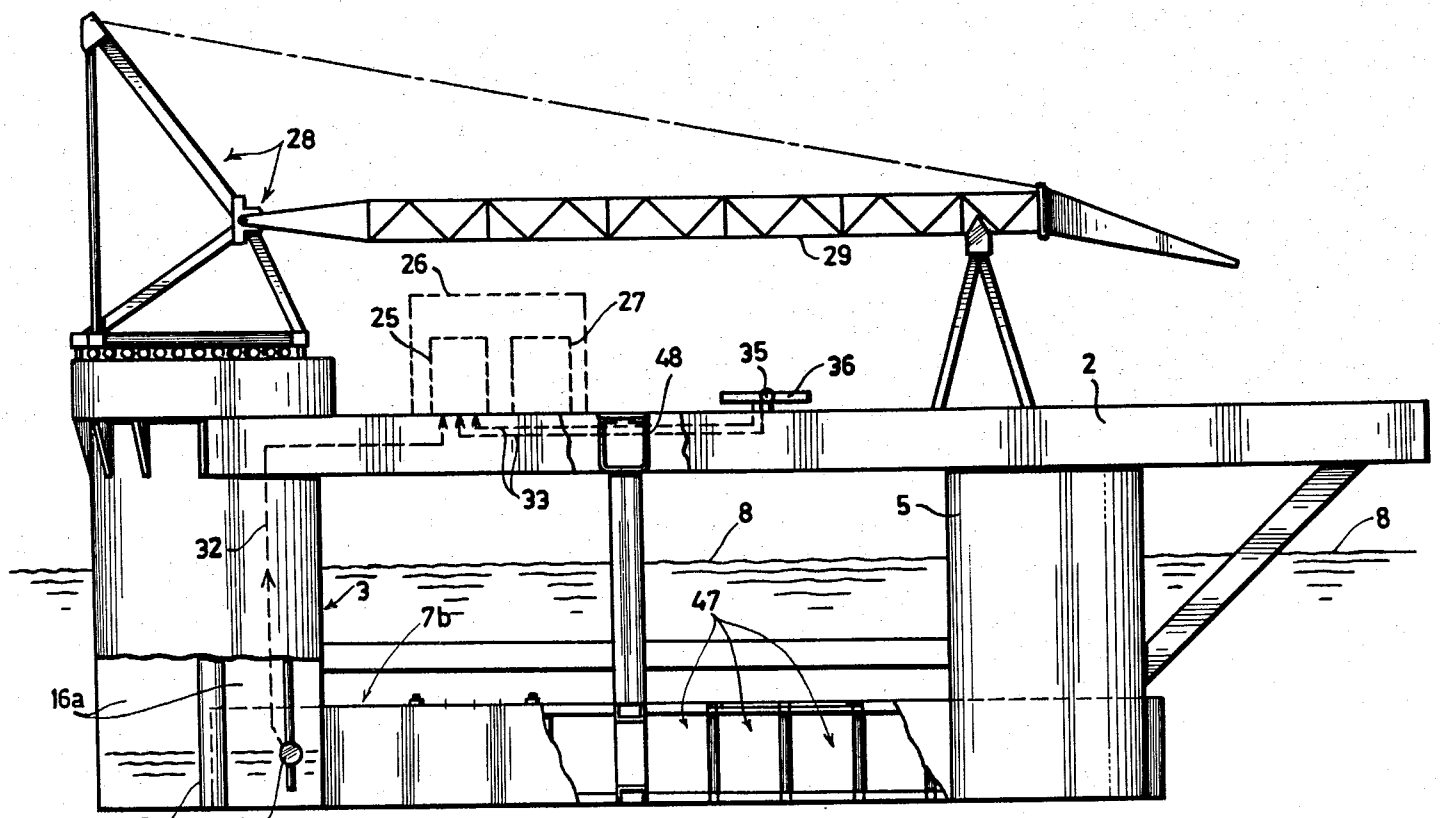
FIG. 3 is a schematic side view in a slightly modified embodiment but wherein the same principles are applied and wherein a ship crane at rest on the platform is shown with a schematic indication of a computer unit which is combined according to the invention, with a unit comprising devices for the control of outboard load handling by one or more cranes.
Figure 4:
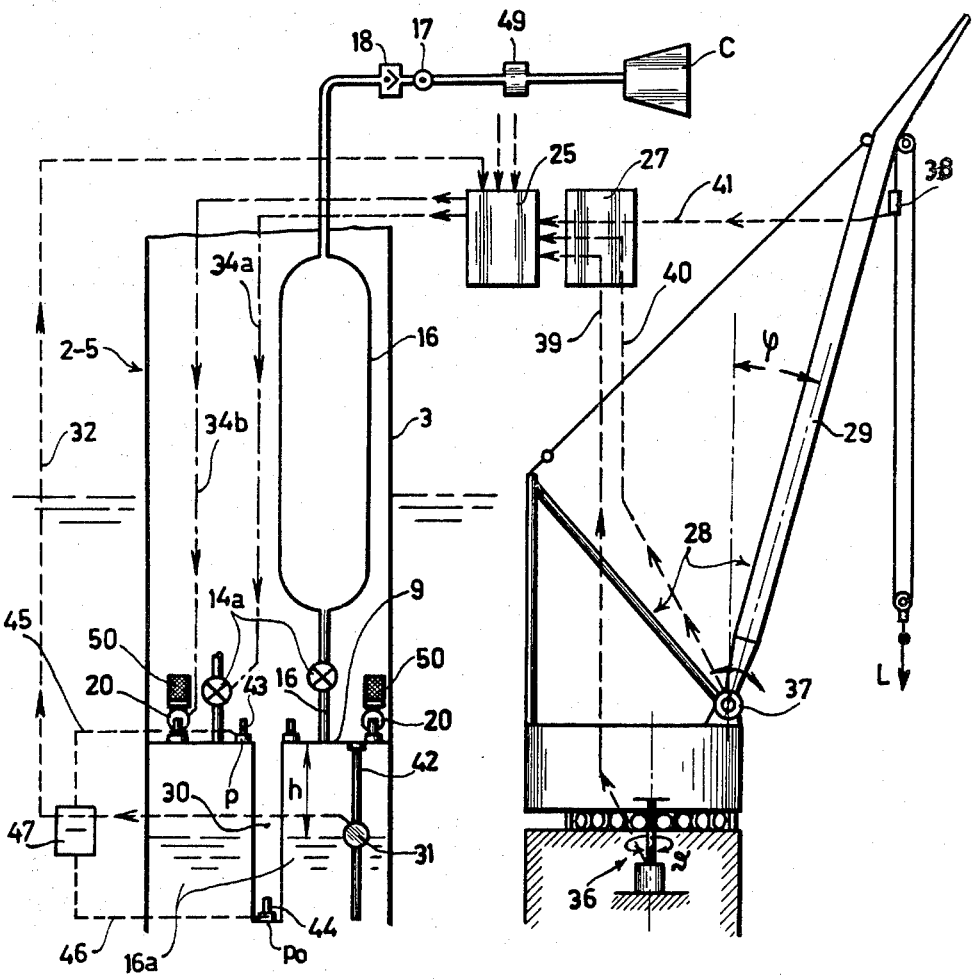
FIG. 4 shows some detailed parts, schematically in cross section and side view wherein sensors and measuring instruments are designated within one of the vessel columns and on a crane as they can be applied in the embodiments of FIGS. 1 or 3 and connected with the abovementioned control units.

For the stabilization of the vessel during the outboard handling of loads by cranes on the vessel, the air valves as mentioned are controlled automatically following commands issued by a computer and for this purpose the measurements registered by sensors and other measuring devices are fed into said computer. This is schematically illustrated in FIGS. 3-5, showing an embodiment which is structionally slightly different from that of FIGS. 1 and 2 but principally the same.

The computer can be of any type suitable for the invention and the details of its construction and programming are of no significance in the present invention, but will be evident to those skilled in the art. For example, reference can be made to "Modern Control Engineering" of K. Ogata, Chapters 10 and 13, Prentice Hall, and to U.S. Pat. No. 3,928,754.

A computer unit 25 is situated in an operator cabin 26 together with a unit 27 for operating a crane as designated by 28. In FIG. 3 the crane has a simpler shape than in FIG. 4, the representation in both figures being only symbolic. In FIG. 4 the crane is shown in a working position wherein its jib 29 has been swung outboard.

The cranes are preferably mounted on top of one or more corner columns each provided with an air bell chamber as described.

A gantry crane may be mounted on two corner columns at one end of the vessel.

Cross bracings and struts which connect the submerged hulls 7*a*, 7*b* and the columns with each other and with the platforms are only partly and superficially designated in FIG. 4, as their showing is not necessary for illustration of the present invention.

In FIGS. 3 and 4 the air chambers such as 16*a* in the lower part of column 3 are divided into several compartments by vertical partition walls running radially from a central tube 30 to the wall of column 3. Each of these compartments is provided with a device measuring the water level in this compartment and as an example therefore a float gauge is designated by 31.

The measuring results are transferred as electrical signals to the computer 25 through a line 32. Angular displacements of the vessel in vertical planes caused by hoisting, traversing of delivering an outboard load by a crane 28 can be continuously registered by angle measuring devices known per se and as symbolically designated in FIG. 3 by two level tubes 35, 36 at right angles to each other on the platform 2. The electrical indications given thereby are fed through lines 33 to the computer 25.

The air valves 13, 14*a-c* respectively are controlled following the data delivered by the computer 25, along electrical conduits as indicated by chain lines 34*a,b* for valves 14*a* and 20 in FIG. 4. In dependence thereof compressed air is admitted to and water driven out from the compartments which would otherwise descend owing to the load and the angular displacement caused thereby. By controlling valves 20, 20*a-c* following commands from the computer 25, air can also be discharged from the compartments which otherwise would raise but wherein now contrary thereto the water is raised.

Data relating to vertical displacements may also continuously be recorded and care can be taken thereby that the draft of the vessel is maintained at a predetermined value. It will be understood that such measures have importance, for example, for moving hoisting loads from and/or letting them down upon a bearing surface at a given level outside the vessel.

The buoyancy of any air bell chamber 15, 16*a-c* can rapidly brought at its desired value because water can stream in and out at its lower end practically without resistance, and air can reach high stream velocities at small pressure differences.

For loads of arbitrary weight and affecting the vessel at any place to be chosen a very fast stabilization can particularly be obtained by measuring the angular displacements of the vessel in vertical planes, as well as the vertical displacements together with the accelerations caused thereby by means of accelerometers and feeding the data taken up into the computer, which computes the desired water level for each air chamber and gives corresponding control commands for selective control by the valve for stabilization.

The data taken up to be fed into the computer were mentioned hereabove as delivered by a water level meter 31 on the one hand and by inclination meters such as 35, 36 on the other hand.

However, for fast, accurate and safe stabilization when moving loads by a crane, it is of great importance to introduce such values into the computer as can be measured directly at the crane, giving indications for the weight and the position of the load with respect to the vessel.

In this way it is possible to bring the control system for the air valves into action as soon as a load is hoisted by a crane and before the vessel has undergone an appreciable angular or vertical displacement.

The right-hand part of FIG. 4 is illustrative for the position of such measuring instruments. Numeral 30 designates a device measuring the angle $\theta$ of the slewing circle through which the crane 28 has moved around a vertical axis from a zero-point in clock-wise or counter-clockwise direction. At 37 a meter is situated for indicating the luffing angle $\phi$ of the crane. So called synchroresolvers can be used for measuring these angles $\theta$ and $\phi$.

The weight of the load L can be measured by a tension meter box 38 using the principle of strip stretch measuring.

The results of the measures are fed along lines 39–41 into the computer 25. The means for transfering the results into electrical signals and the use thereof in the computer together with other input data as mentioned before providing command signals to the air valves are known to one skilled in this art.

For measuring the water level in chambers 16*a* a float gauge 31 has been mentioned which is shown in FIG. 4 as movable along a vertical rod 42. However, this type of instrument can easily fail and repair would be difficult because chamber 16*a* is not easily accessible. Therefore instead thereof, the desired water level indication is preferably obtained by measuring the air pressure p in the air chamber by means of an inductive pressure sensor 43 on top of the chamber and a sensor 44 at the bottom of the tube 30 measuring the water pressure $p_o$ at the exit of the chamber into the surrounding water. The value $p_o$–p is a measure for the water level in the chamber. For the sensors 43 and 44 membrane instruments may be applied with inductive displacement indications as known per se.

These measures provide at the same time the opportunity to remove the influence which pressure-changes causes by waves would have on the air valve control system.

This is in contrast to the system of the aforementioned U.S. Pat. No. 2,889,795 which has been devised for control of the air pressure in dependence of wave movement.

This should be avoided in the application of the present invention because the introduction of the abovementioned pressure changes into the control system would only disturb the stabilization in dependence of load handling as desired. When the cranes are not operating, the waves have little influence on the keel eveness because the invention is applied to a vessel having submerged buoyancy hulls 7*a*, 7*b* and for its buoyancy it is not dependent on the platform supporting columns.

Now the removal of wave pressure influence can be obtained simply by introducing into the computer the product of the measured values, i.e. p.h. for measurement by a float 31 or p($p_o$–p) for measuring pressure differences as explained hereabove. This is designated symbolically in FIG. 4 by lines 45, 46, passing through unit 47, from which the product value is put into line 32.

By removing the influence of pressure differences caused by waves for the stabilization, savings are obtained in the consumption of compressed air.

It will be understood that the computer is programed so as to send selective commands to each of the controled air valves 20, 14*a* by which during crane operation, the air pressure in the air bell chambers is adjusted continuously to values corresponding to a substantially even keel of the vessel, notwithstanding the different moments applied to the vessel caused by crane loads during operation of a crane. The commands can be given e.g. to an electropneumatic operation mechanism for each air valve.

Different computer programs will be made operational for different circumstances. When hoisting, for instance, a load from or putting it down on the platform itself the indication by the weight meter 38 will change, though this should have no influence on the valve control as nothing changes under these circumstances in the forces influencing a keel eveness of the vessel.

After finishing a load operation a separate computer program may be used to bring the water levels in all air chambers to a level corresponding to the starting situation.

In correspondence with this return program e.g. water may be pumped into or out of selected water ballast compartments in the submerged hulls 7*a*, *b* as these are designated by 47 in FIG. 3 for a sub-divided portion of the hull 7*b*.

An advantage resulting from the present invention is that the cranes do not need a weighty counter ballast for the loads to be hoisted.

During hoisting of a load from a fixed outboard support the vessel may be lifted in the crane area by a wave, by which the crane load will be increased temporarily. Means can be provided to maintain the maximum load value reached under these circumstances in the computer without changing the corresponding setting of the air valves. The crane operation in upward direction is continued during this period and at the time that a wave dale follows and the crane load moment increases again above the temporarily "maintained" maximum, the commands to the air valves are continued in the same sense as before. In a corresponding way load moment minima caused by waves can be maintained temporarily by the computer when a load is deposited upon a fixed outboard support.

Under normal conditions the increase of the load moment when lifting a load from an outboard support will always pass off progressively as then the vessel platform is inclined to descend at the load side, but the automatic stabilization to an even keel will help to lift the load and sufficient time will be available for this automatic stabilization. Corresponding considerations are applicable for putting down of a load outboard.

It has been found that according to the invention the outboard crane load may increase e.g. within 15 sec. from 0 to 3000 tons maintaining a substantially even keel.

In FIG. 3 also a side portion of the platform 2 is broken away showing a section through a cross beam 48.

The number 49 in FIG. 4 designates an air pressure regulating valve and numbers 50 designate sound absorbers on the air blow off valves 20. Further in FIG. 4 the air reserve chamber 16 is shown as an air pressure tank.

What is claimed is:

1. A semi-submersible crane vessel comprising a platform, a plurality of vertical hollow columns supporting the platform, said columns being distributed along a circumferential outer region of the vessel, submerged bouyancy hulls supporting said columns such that the platform is above water level, and a stabilizing system for stabilizing the vessel with respect to outboard handling of loads by at least one crane on the vessel, said stabilizing system comprising ballast chambers in said bouyancy hulls, valve means for selectively admitting surrounding water into said chambers, said chambers comprising (a) air chambers at the lower ends of said columns at the level of said submerged buoyancy hulls; (b) said air chambers having a top closure below the level of the water surrounding said submerged buoyancy hulls, a bottom connection in communication with the surrounding water and vertical air conduits extending upwardly from said chambers for connecting the latter to ambient atmosphere; (c) means for controlling said valves for admission of desired amounts of water into said air chambers during handling of a crane load in dependence on the weight of said loads and the position of said loads with respect to said vessel and measuring means including gauging means for measuring the water level in each said air chamber, said gauging means including an air pressure sensor for each of said air chambers and a water pressure sensor at the exit of each said chamber to the surrounding water, the difference between said sensed pressures being indicative of the water level in each said first air chamber.

2. A crane vessel as defined in claim 1 comprising accelerometers for measuring acceleration values of the vessel.

3. A semi-submersible crane vessel comprising a platform, a plurality of vertical hollow columns supporting the platform, said columns being distributed along a circumferential outer region of the vessel, submerged bouyancy hulls supporting said columns such that the platform is above water level, and a stabilizing system for stabilizing the vessel with respect to outboard handling of loads by at least one crane on the vessel, said stabilizing system comprising ballast chambers in said bouyancy hulls, valve means for selectively admitting surrounding water into said chambers, said chambers comprising (a) air chambers at the lower ends of said columns at the level of said submerged buoyancy hulls; (b) said air chambers having a top closure below the level of the water surrounding said submerged buoyancy hulls, a bottom connection in communication with the surrounding water and vertical air conduits extending upwardly from said chambers for connecting the latter to ambient atmosphere; (c) means for controlling said valves for admission of desired amounts of water into said air chambers during handling of a crane load in dependence on the weight of said loads and the position of said loads with respect to said vessel, vertical partition walls in said first air chamber dividing the same into compartments, said vertical partition walls extending from a central zone of each of said first chambers to outer chamber walls, each of said compartments being provided with one of said air valves and with pressure sensor means, said pressure sensor means comprising a water pressure sensor common for said air compartments arranged at the bottom end of a tube formed in the center of said air chamber.

4. A crane vessel as defined in claim 3, comprising measuring devices including gauging means for measuring the water level in each said first air chamber, for the angular displacement of the vessel with respect to vertical planes and for vertical displacements of the vessel at the locations of measurement.

5. A crane vessel as defined in claim 1 or 3 wherein said means for emptying water from said chambers with replacement with air comprises a plurality of further air chambers, each associated with a respective one of the first said air chambers, valves for controlling air flow between said further air chambers and the first said air chambers, a source of compressed air and means connecting said source of compressed air to said further air chambers.

6. The crane vessel as defined in claim 1 or 3, wherein said vessel has corners and selected of said columns are arranged at the corners of said vessel, said crane being mounted on said platform above at least one of said corner columns.

7. The crane vessel as defined in claim 1 or 3, comprising measuring instruments for measuring the slewing and top angles of a crane at any time for a given load from the starting moment of its hoisting.

* * * * *